United States Patent [19]

Knoblauch et al.

[11] 4,438,898

[45] Mar. 27, 1984

[54] CHAIN CONTROL LOCKING ASSEMBLY

[75] Inventors: Jack R. Knoblauch, Byron Center; Duane M. Beukema, Grand Rapids; Kenneth W. Hozeski, Grandville, all of Mich.

[73] Assignee: Steelcase Inc., Grand Rapids, Mich.

[21] Appl. No.: 145,622

[22] Filed: May 1, 1980

[51] Int. Cl.[3] ..... F16M 13/00

[52] U.S. Cl. ..... 248/561; 297/304; 297/328

[58] Field of Search ..... 248/561; 297/304, 305, 297/306, 328

[56] References Cited

U.S. PATENT DOCUMENTS

| | | | |
|---|---|---|---|
| 1,674,846 | 6/1928 | Streit | 297/328 |
| 2,627,299 | 2/1953 | Martin | 297/328 |
| 3,480,249 | 11/1969 | Lie | 297/328 |
| 3,627,252 | 12/1971 | Yamaguchi | 297/328 |
| 4,099,775 | 7/1978 | Mizelle | 297/328 |
| 4,214,726 | 7/1980 | Karrip | 297/304 |

FOREIGN PATENT DOCUMENTS

| | | | |
|---|---|---|---|
| 669160 | 9/1965 | Belgium | 297/328 |

*Primary Examiner*—Francis K. Zugel

*Attorney, Agent, or Firm*—Price, Heneveld, Huizenga & Cooper

[57] ABSTRACT

The specification discloses a chair control in which the tiltable member can be locked against movement with respect to the stationary member by means of a rigid locking plate pivotally mounted on the tilting member and rotatable by an actuator rod, having a bell crank type lever formed therein, into close proximity with the stationary member to thereby physically block relative movement between the tiltable and stationary members.

30 Claims, 12 Drawing Figures

CHAIN CONTROL LOCKING ASSEMBLY

BACKGROUND OF THE INVENTION

The present invention relates to chair controls. Chair controls are devices mounted underneath the seat of the chair typically to control the tilting of the chair when a person leans back in it. They usually comprise a stationary member adapted to be mounted on a pedestal base and a tiltable member or members pivotally mounted to the stationary member. The tiltable member is then secured to the chair seat or back. There is a bias member or energy storing device which controls the rate at which one can tilt rearwardly in the chair with the application of a given force and which returns the chair to its normal position when the user stops leaning back. Many users of tilter chairs consider it desirable to be able to lock the chair against tilting. While it is nice to be able to lean back in a chair and think or reflect about a particular project, there are also "doing" tasks where it is nice to sit up to your desk and still receive some support from your chair when you lean back in it. To perform such "doing" tasks, some users like to be able to lock their chair control against tilting motion.

Such locking devices have been proposed in prior art chair controls. U.S. Pat. No. 2,991,125 discloses some type of chair control in which a small cylinder is mounted between the base and back of the chair, which cylinder can be locked against movement to thereby lock the chair against tilting action. U.S. Pat. No. 3,602,537 to Kerstholt and U.S. Pat. No. 4,062,587 to Wolters disclose another type of locking mechanism wherein members which are normally movable with respect to one another can be clamped tightly against one another to prevent movement.

These mechanisms are complex in construction. Further, parts which are normally movable with respect to each other are placed under a good deal of stress by being clamped against one another. The mechanisms doing the clamping and locking action are accordingly subject to wear and tear.

SUMMARY OF THE INVENTION

The chair control of the present invention includes a locking means of a relatively simple and inexpensive construction which also avoids the need for clamping devices or expensive cylinders. In the chair control of the present invention, the locking means comprises a rigid member movably mounted on the chair control and operably connected to actuator means capable of moving the rigid member between a locking position and an unlocking position. The rigid member has such a configuration and orientation in its mounting to the chair control such that when in its locking position, it extends from a position of operable engagement with the tilting member to a position of operable engagement with the stationary member thereby preventing relative movement between the two. When in its unlocking position, it is out of operable engagement with at least one of the stationary or tiltable members whereby the tiltable member can tilt with respect to the stationary member.

These and other objects, advantages and features of the invention will be more fully understood and appreciative by reference to the written specification and appended drawings.

DESCRIPTION OF THE PREFERRED EMBODIMENT

Figure 1:
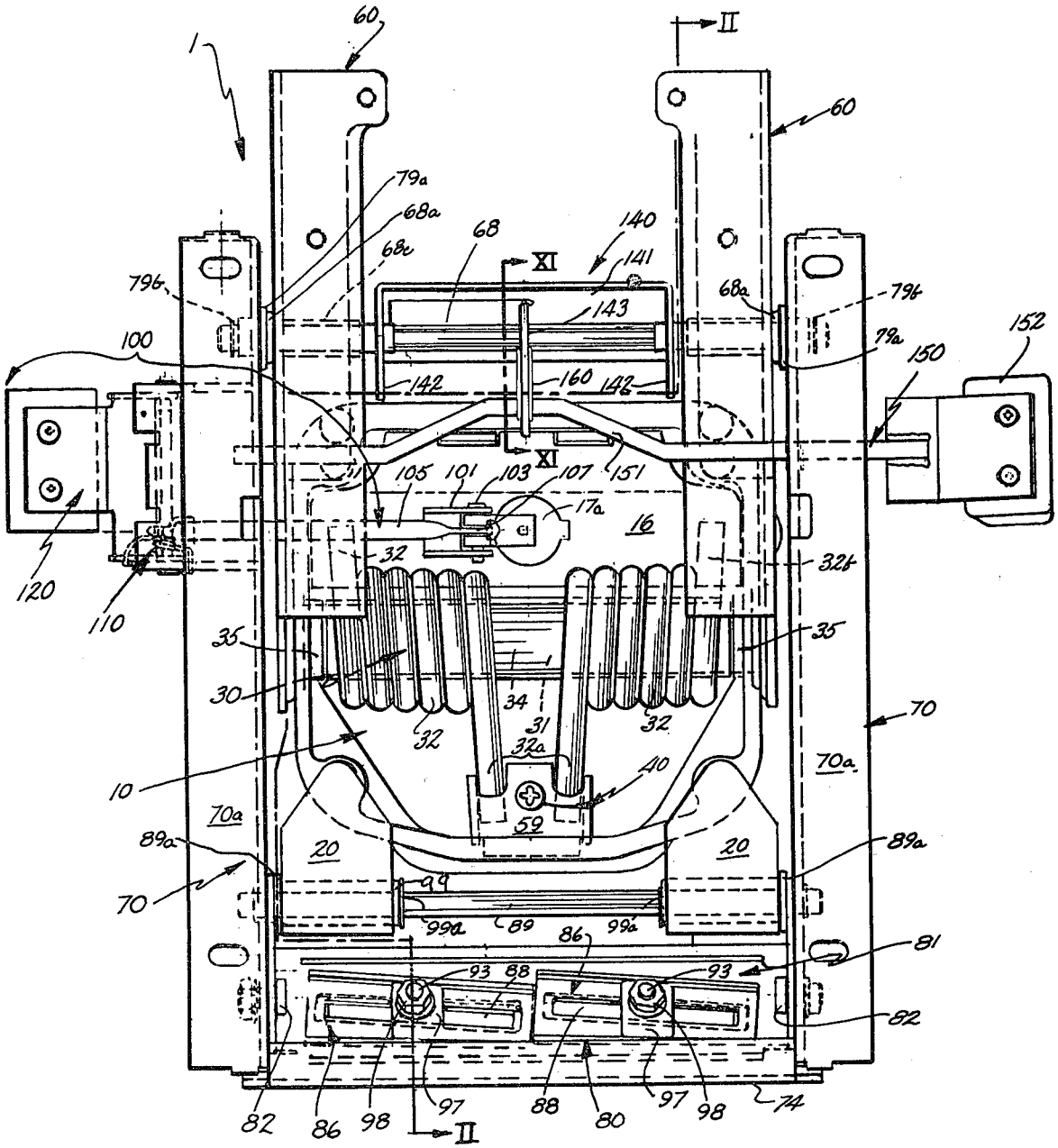
FIG. 1 is a plan view of a chair control made in accordance with the present invention.
Figure 4:
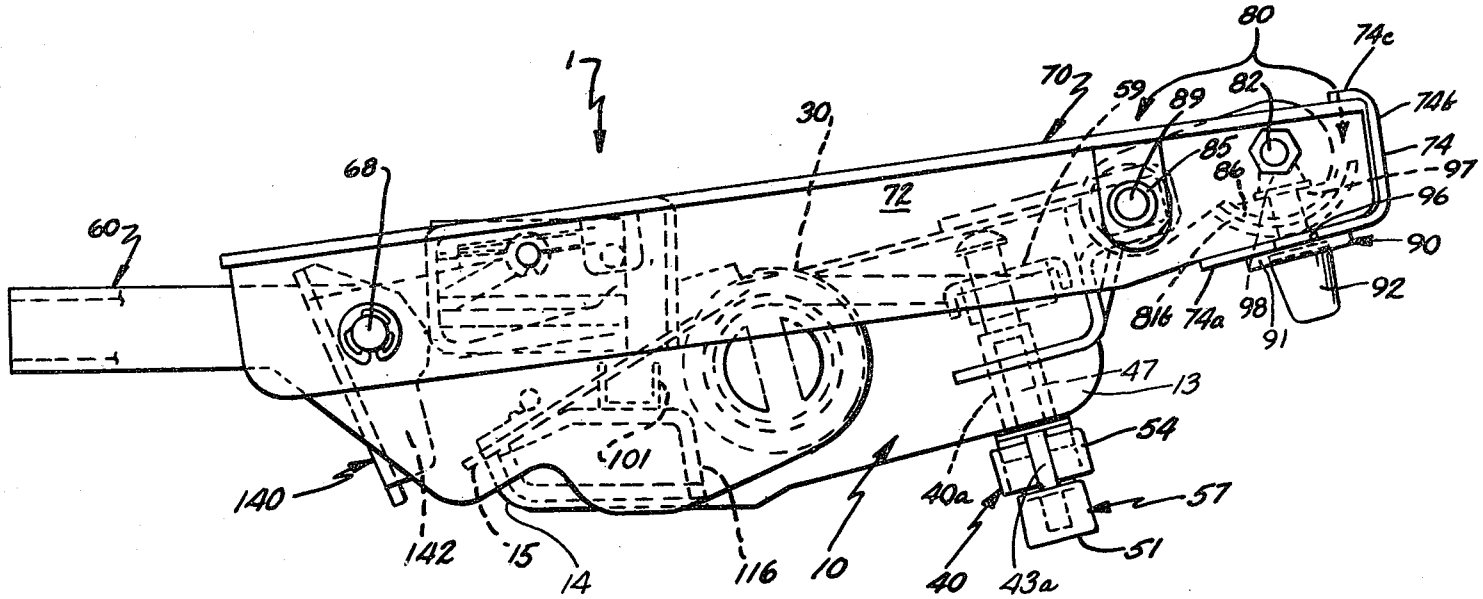
FIG. 4 is a side elevational view of the chair control with some of the internal components being shown in hidden lines.

Chair control 1 comprises a stationary control housing 10 which houses a bias means 30 (FIGS. 1 and 4). The degree of pretension on bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount could be direct, but in the embodiment shown is through a seat adjustment assembly 80 which does not comprise part of this invention per se and hence is not described in detail below.

Tiltable back support arms 60 and seat support 70 can be locked against tilting movement by chair control locking plate 140. Rigid locking plate 140 pivotally mounted on back support arms 60 can be rotated by actuator rod 150 into operable engagement with the rear of stationary housing 10, thereby blocking tilting movement.

Chair control 1 as shown is a synchrotilt control, having a seat tilt member and back tilt member which both tilt, but at different rates. The present invention would also be operable in other types of controls where only one tiltable member is provided. Also, other desirable features are shown in the drawings and may be briefly referred to herein, but they are not described in detail since they do not pertain per se to the locking assembly 140.

Figure 2:
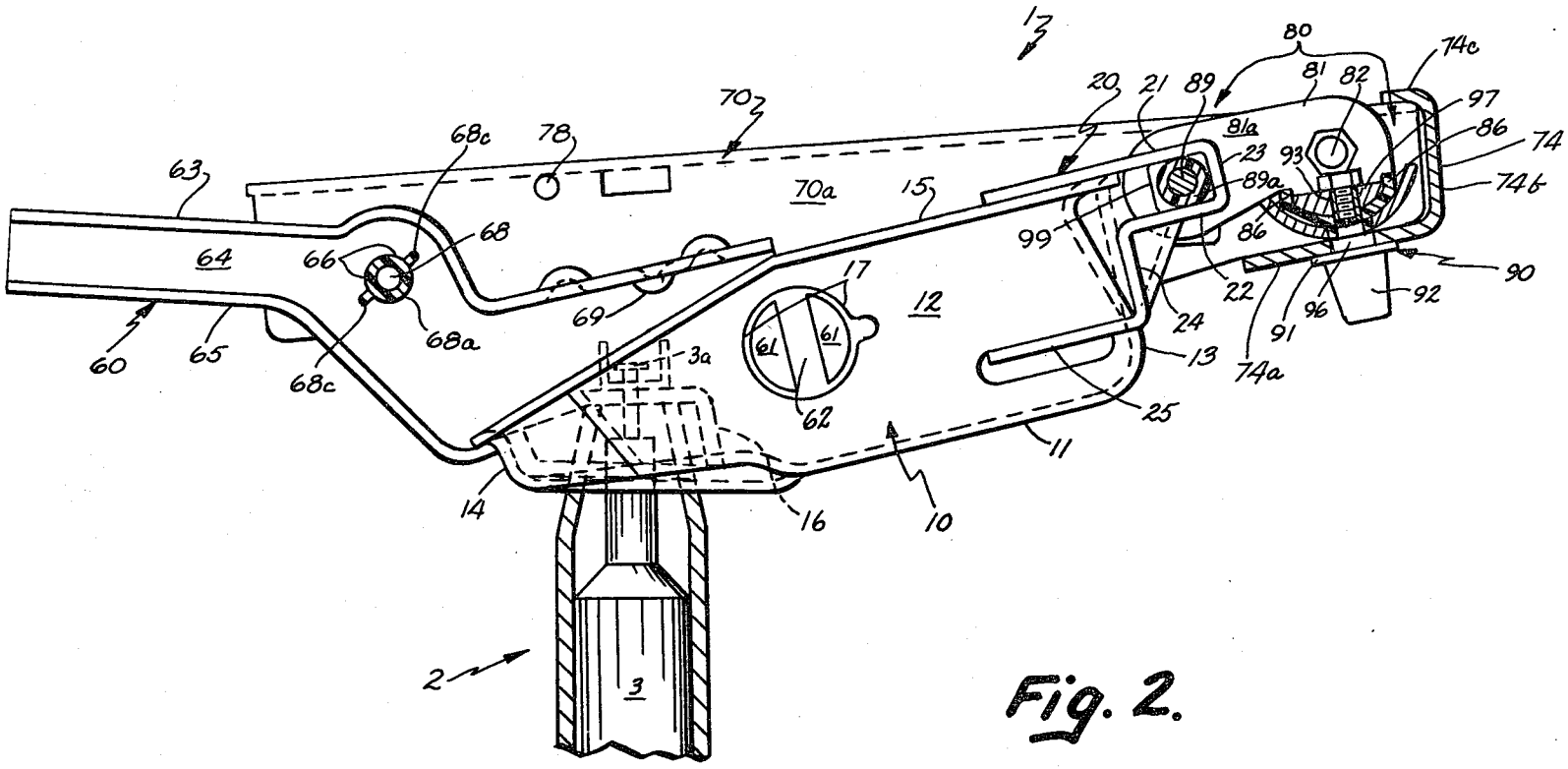
FIG. 2 is a fragmentary cross-sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
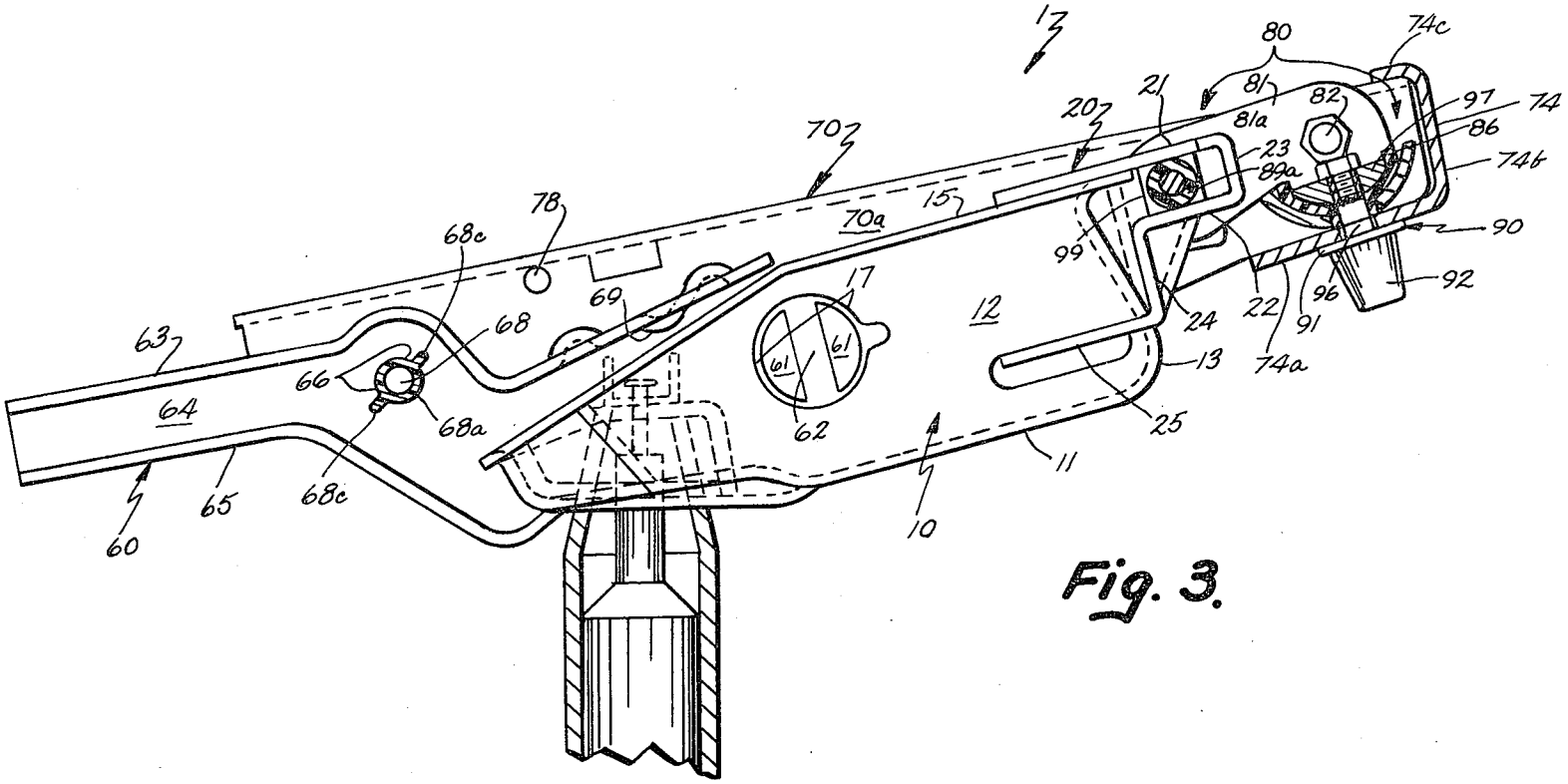
FIG. 3 is the same view as FIG. 2, but with the chair control in the position which it assumes when a person leans back in a chair to which the chair control is attached.

Stationary control housing 10 is a stamped or otherwise formed metal dish having a bottom wall 11, side walls 12, a front wall 13 and rear wall 14 (FIGS. 2 and 3). A lip 15 extends around the upper periphery (see FIG. 2). There is an aperture in bottom 11 through which the upper end of spindle 2 extends. A spindle mounting plate 16 is welded to the inside of housing 10 and includes an aperture 17*a* therein to also receive the upper end of spindle assembly 2 (FIGS. 1 and 2).

Bias means 30 comprises a torsional coil spring arrangement. An arbor 31 which is generally circular in cross sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof, The rear ends 32*b* of springs 32 are captured under the chair back support arms 60. Tension adjustment is achieved by tightening or loosening tension bolt 40 in retainer nut 59. Basically, tension adjustment bolt assembly 40 comprises a bolt 40*a* having a hollow shank normally housing a lever 47. One can grasp gripping cap 51, retract lever 47, pivot it to one side into a slot 43*a* and rotate it to thread bolt 40*a* up or down in retainer 59.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 60 is visible through the hole 17 in the side of stationary housing 10 in FIG. 2. There are two semi-circles 61 spaced by a bridge 62. The ends of arbor 30 are slotted so that they fit into the semi-circles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs, Located about midway along the length of each chair back support arm 60 is a hole 66 which is adapted to receive the rear axle 68 and suitable bearing 68*a*. It is on the rear axle 68 that the rear of chair seat support assembly 70 is pivotally carried.

The chair seat support assembly 70 comprises a pair of spaced stretchers 70*a* joined at the front by front piece 74 (FIGS. 1, 2, 5 and 6). Each side stretcher 70*a* is formed of steel to define a top ledge 71 and a side wall 72. There are mounting holes 76 in top ledges 71 to facilitate mounting chair control 1 to the bottom of a chair seat. There is an aperture 78*a* in the same side stretcher and a similar aperture 78 in the other side stretcher 70*a* through which the chair control lock actuator rod 150 extends.

Located towards the rear of each side wall 72 of each stretcher 70*a* is a rear axle receiving hole 79 (FIG. 6) which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

The purpose of locking plate 140 is to lock the chair back in its upright condition, making it impossible for a person to tilt the chair and chair control 1 rearwardly. Referring to FIGS. 1, 4, 7 and 8, it will be seen that locking plate 140 comprises a rigid metal plate which has been formed to define a pair of spaced side walls 142 and a middle leg 143, all projecting in the same direction from and joined by a back wall 141. Each side wall 142 includes a keyhole opening 144 therein. Middle leg 143 simply includes a round hole 145 therein. Locking plate 140 is pivotally mounted to chair control assembly 1 by means of rear axle 68 extending through keyholes 144 and hole 145, all of which are in alignment with one another. As can be seen by reference to FIG. 1, each axle bearing sleeve 68*a* extends inwardly sufficiently far that a portion thereof extends through each of the end openings 144 in side walls 142. As can be seen by reference to FIG. 8, each bearing sleeve 68*a* also includes a small projecting spline 68*b* which extends into the slot portion of keyhole 144. Spline 68*b* is narrower than the width of the slot portion of keyhole 144 so that lock plate 140 can be rotated about bearing 68*a*, yet spline 68*b* serves as a stop to prevent rotation beyond certain limits. This prevents plate 140 from clanking noisely against lip 15 on housing 10. Bearing sleeve 68*a* will not itself rotate relative to chair back support arms 60 in that it includes other splines 68*c* received within similar notches in the apertures 66 in arms 60 (see FIGS. 1 and 2).

Referring to FIG. 4, it can thus be seen that when locking plate 140 is rotated counterclockwise as viewed in FIG. 4, the bottom of its side walls 142 will come into position above the lip 15 along the rear edge of stationary housing 10. Side walls 142 are dimensioned such that when in that position, one cannot tilt back support arms 60 downwardly since the bottom edge of side walls 142 immediately comes into abutment with lip 15, or preferably into abutment with some sort of sound deadening plastic bumper, not shown in FIG. 4. When in this locking position, plate 140 is in operable engagement with stationary housing 10 in and with tilting back supports 60 in that it blocks any significant relative tilting of the two. As thus intended, the term operable engagement still allows for a slight space between plate 140 and housing 10 when the control is "at rest".

Figure 5:
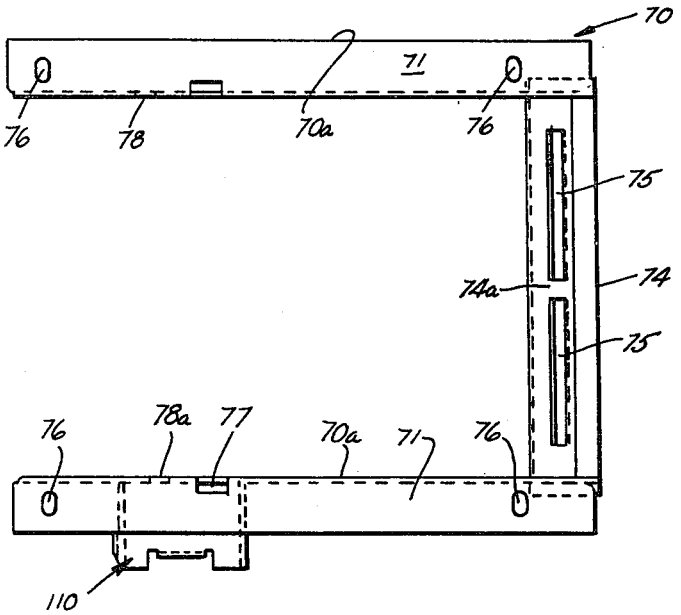
FIG. 5 is a top plan view of the chair seat supporting assembly 70.
Figure 6:
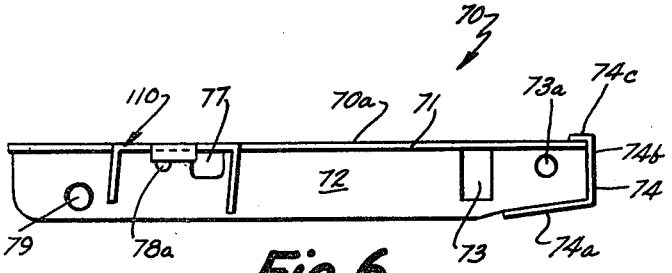
FIG. 6 is a side elevational view thereof.
Figure 7:
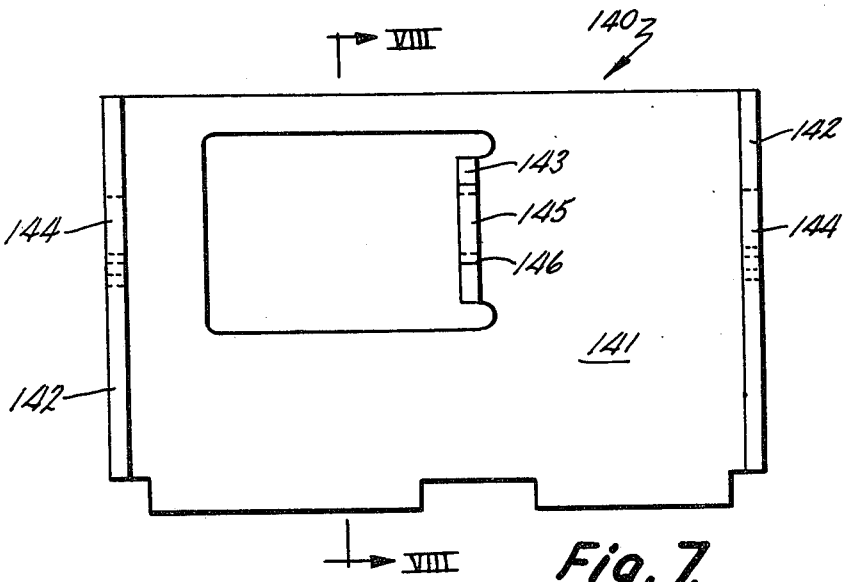
FIG. 7 is a front elevational view of the back upright lock plate 140.

In order to facilitate rotation of lock plate 140 from its unlocked condition as shown in FIG. 4 to its locked condition as described above, a lock actuator rod 150 is provided which extends through a hole 78 in one side stretcher 70*a* (compare FIGS. 1 and 2) and is rotatably received in a similar hole 78*a* in the opposite side stretcher 70*a* (see also FIG. 5 where holes 78 and 78*a* are shown hidden). It will be noted that seat support 70 is located above back support 60 in elevation, in part so that lock actuator rod 150 will extend out over one back support 60 without interfering with it (FIGS. 2–4). Indeed, back support arm 60 deviates downwardly after it goes over pivot axel 68 and then slopes back upwardly towards the front of control 1 so as to create a depression in the vicinity of lock actuator 150, thereby, insuring an absence of interference even when control 1 is tilted.

Figure 8:
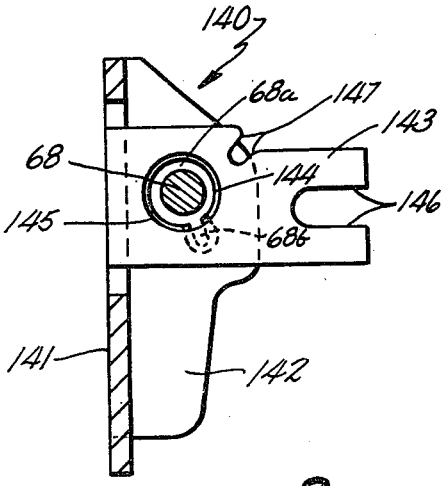
FIG. 8 is a cross-sectional view thereof taken generally along plane VIII—VIII of FIG. 7, but with pivot axle 68 shown extending therethrough.

Lock actuator rod 150 includes generally U-shaped deviation or lever or bell crank portion 151 in its central part. The base of lever or bell crank portion 151 is located within a notch 146 cut in the end of middle leg 143 of lock plate 140 (FIG. 8). Mounted on the end of lock rod 150 is an enlarged handle 152. By depressing handle 152 towards either side of its axis of pivoting, one rotates rod 150 and thereby moves bell crank 151 upwardly or downwardly. This in turn rotates lock plate 140 about rear axle 68 and facilitates movement of lock plate 140 from its locked to unlocked condition or visa-versa.

Figure 9:
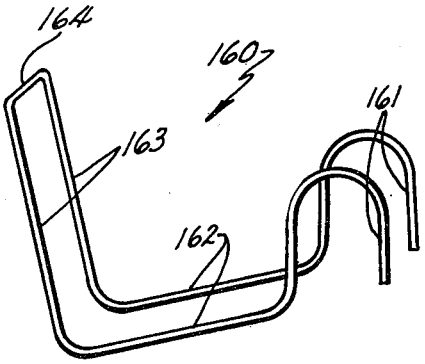
FIG. 9 is a side elevational view of the back plate spring 160.
Figure 10:
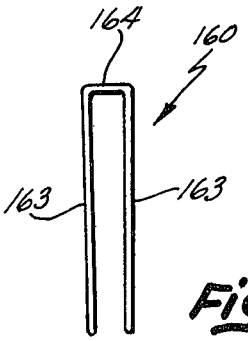
FIG. 10 is an end elevational view of said spring.
Figure 11:
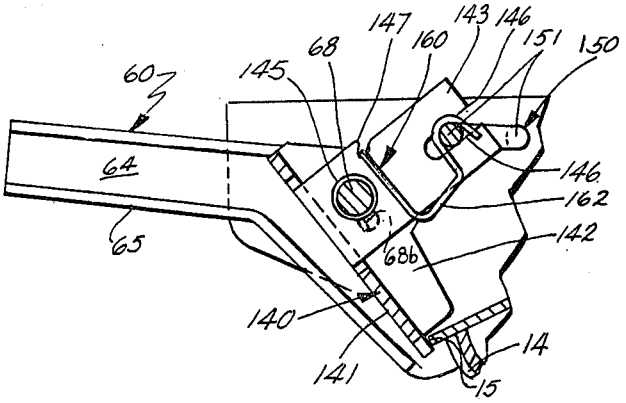
FIG. 11 is a fragmentary, sectional view taken along plane XI—XI in FIG. 1 showing the chair back locked in its upright position.
Figure 12:
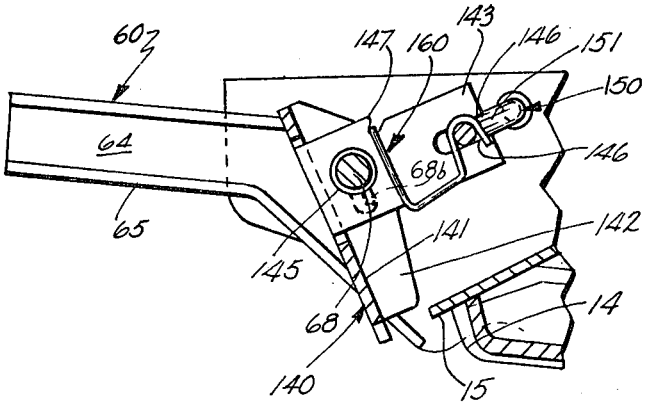
FIG. 12 is a fragmentary, sectional view taken along plane XI—XI in FIG. 1 showing the locking plate in its unlocked position permitting the chair back to tilt.

Spring 160 (FIGS. 1, 9 and 10) biases lock plate 140 and lock actuator rod 150 to either the unlocked position or locked position through an over center action. This prevents lock plate 140 from being inadvertently moved one way or the other. Referring particularly to FIGS. 9 and 10, it will be seen that spring 160 comprises a pair of open looped ends 161 which are located in side by side, spaced relationship. Each then is bent into a rearwardly extending leg 162 which in turn terminates in an upwardly bent upwardly extending rear leg 163. Legs 163 are joined at their ends by a short bight 164. When viewed from the end (FIG. 10), spring 160 has a generally U-shaped configuration at one end, with legs 163 defining the sides of the "U". In assembly, spring 160 fits over leg 143 of back plate 140 such that bight 164 fits into a small notch 147 cut into the top of leg 143 (FIG. 8). The looped ends 161 then fit over and are preferably closed around the base of bell crank 151 of lock rod 150. Spring 160 then tends to hold lock plate 140 in either its locked or unlocked condition, depending on the position of bell crank 151.

OPERATION

With the various assemblies, sub assemblies and components thus described, the operation of chair control 1 can be more fully appreciated. As a person leans back in a chair to which chair control 1 is assembled, the chair back support arms 60 begin to pivot about their pivotal mounting (on arbor 31) to stationary housing 10. At the same time the rear of seat support stretcher assembly 70 begins to shift downwardly relative to its front since chair seat support stretcher assembly 70 is pivotally joined to back support arms 60 by rear axle 68. The front of seat support assembly 70 pivots about front axle 89 which, along with its bushings 99, slides rearwardly in tracks 20. FIGS. 2 and 3 illustrate chair control 1 in its untilted and fully tilted conditions respectively. The various pivot points are located such that the chair back tilts rearwardly at a rate which is approximately twice as fast as the rate of tilt for the seat.

If one wishes to lock the chair against any tilting motion, one simply reaches under the side of the chair seat and pushes upwardly against the rear portion of handle 152. This twists lock actuator rod 150 and pivots bell crank 151 upwardly. This in turn pivots lock plate 140 in a counterclockwise direction as viewed in FIG. 4, thereby causing the bottom edges of lock plate sidewalls 142 to come into position above the lip 15 of the rear portion of stationary housing 10. This makes it impossible to pivot back support arms 60 downwardly and hence makes it impossible to tilt rearwardly in the chair to which chair control 1 is mounted.

Of course, it is understood that the above is merely a preferred embodiment of the invention and that various changes and alterations can be made without departing from the spirit and broader aspects thereof as more particularly defined in the appended claims.

The embodiment of the invention in which an exclusive property or privilege is claimed are defined as follows:

1. In a chair control having a stationary member for mounting to a base, a tiltable member pivotally mounted with respect to said stationary member, bias means operably connected between said stationary and tiltable members for controlling the rate of tilt of said tiltable member with respect to said stationary member and for biasing said tiltable member to a normal position, and means for locking said tiltable member with respect to said stationary member, the improvement in said chair control comprising: said locking means including a rigid member movably mounted on said chair control; a pivotally mounted rod having a deviation therein defining a lever, said lever engaging said rigid member and pivoting said rigid member when said rod is twisted, said rigid member being of such a configuration and having such an orientation in its mounting to said chair control that when in said locking position, it extends from a position of operable engagement with said tilting member to a position of operable engagement with said stationary member, thereby preventing relative movement of the two, and such that when in said unlocking position, it is out of operable engagement with one of said tiltable and stationary members whereby said tiltable member can tilt with respect to said stationary member.

2. In a chair control having a stationary member for mounting to a base, a tiltable member pivotally mounted with respect to said stationary member, bias means operably connected between said stationary and tiltable members for controlling the rate of tilt of said tiltable member with respect to said stationary member and for biasing said tiltable member to a normal position, and means for locking said tiltable member with respect to said stationary member, the improvement in said chair control comprising: said locking means including a rigid member movably mounted on said chair control; actuator means mounted on said chair control and operably connected to said rigid member for moving said rigid member between a locking position and an unlocking position, said rigid member being of such a configuration and having such an orientation in its mounting to said chair control that when in said locking position, it extends from a position of operable engagement with said tilting member to a position of operable engagement with said stationary member, thereby preventing relative movement of the two, and such that when in said unlocking position, it is out of operable engagement with one of said tiltable and stationary members whereby said tiltable member can tilt with respect to said stationary member; stop means positioned to abut said rigid member and stop it, as it is moved towards said stopping position, at a point just short of physical engagement with said one member whereby movement of said rigid member into said locking position will not cause it to clank noisily against said one member.

3. The chair control of claim 2 in which said rigid member is mounted for pivotal movement on a pivot axle which is mounted to said other of said tiltable and stationary members.

4. The chair control of claim 3 in which said stop means comprises: said rigid member including a keyhole opening, said pivot axle passing through the enlarged portion of said keyhole opening and including a spline extending into the slot of said keyhole opening, said pivot axle and said spline being held against rotation and said spline being smaller in width than the width of said slot of said keyhole whereby said rigid member can be pivoted about said pivot axle from the point of engagement of said spline with one side of said slot to the point of engagement of said spline with the other side of said slot.

5. The chair control of claim 4 in which said spline is integrally molded of plastic with a sleeve which fits onto said pivot axle whereby the engagement of said keyhole slot with said spline is relatively noise free.

6. The chair control of claim 5 in which said rigid member is pivotally mounted on said tiltable member.

7. The chair control of claim 6 in which said actuator means is pivotally mounted on said tiltable member.

8. The chair control of claim 4 or 7 in which said actuator means comprises: a pivotally mounted rod having a deviation therein defining a lever, said lever engaging said rigid member and pivoting said rigid member when said rod is twisted.

9. The chair control of claim 8 in which said rigid member includes a leg projecting laterally of said pivot axle and having a slot therein which engages said lever of said actuator rod.

10. The chair control of claim 9 in which said slot in said leg is opened ended whereby said lever of said actuator rod can be slid readily into engagement with said slot.

11. The chair control of claim 10 which comprises: spring means operably mounted between said lever of said actuator rod and said rigid member for biasing said rigid member towards either its locking or unlocking position.

12. The chair control of claim 11 in which said spring means operably engages said actuator rod on its axis of rotation and operably engages and pushes against said rigid member at point which moves through a plane extending from the axis of rotation of said actuator rod and the axis of rotation of said rigid member as said rigid member is shifted between its locking and unlocking positions.

13. The chair control of claim 12 in which said rigid member leg includes a notch therein, said spring means being seated in said notch.

14. The chair control of claim 13 in which said leg includes an aperture therein through which said pivot axle extends.

15. The chair control of claim 13 in which said rigid member includes a generally flat plate.

16. The chair control of claim 15 in which said plate is a metal plate and said leg of said rigid member is integrally formed of said metal plate, being bent laterally out of the plane of said plate.

17. The chair control of claim 16 in which said rigid member further comprises a pair of spaced end legs on either side of said leg, said end legs being integrally formed of said metal plate by bending laterally out of the plane of said plate, said end legs having apertures therein through which said pivot axle passes.

18. The chair control of claim 17 in which said end legs of said rigid member extend over the rear edge of said stationary member when said rigid member is in its locking position, said end legs comprising that portion of said rigid member which are in operable engagement with said stationary member when said rigid member is in its locking position, said rear legs being positioned in very close proximity to the rear of said stationary member but being slightly spaced therefrom whereby they do not clank noisely against said stationary member when said rigid member is moved into its locking position.

19. The chair control of claim 18 in which said plate of said rigid member extends downwardly farther than said end legs to a point generally behind the rear of said stationary member, in close proximity thereto but just out of engagement therewith when said chair control is in its normal position, whereby said plate serves a safety stop to insure that said plate will not be moved past its locking position in the event of failure of said stop means.

20. The chair control of claim 13 in which said spring comprise a pair of looped ends looped around said actuator rod on its axis of rotation, a rearwardly extending leg extending rearwardly from each of said looped ends, an upwardly extending leg extending upwardly from each of said rearwardly extending legs and a bight portion joining the ends of said upwardly extending legs, said bight portion being seated in said notch of said leg on said rigid member.

21. The chair control of claim 2 in which said actuator means comprise: a pivotally mounted rod having a deviation therein defining a lever, said lever engaging said rigid member and pivoting said rigid member when said rod is twisted.

22. The chair control of claim 21 which comprises: spring means operably mounted between said lever of said actuator rod and said rigid member for biasing said rigid member towards either its locking or unlocking position.

23. The chair control of claim 22 or 1 in which said spring means operably engages said actuator rod on its axis of rotation and operably engages and pushes against said rigid member at point which moves through a plane extending from the axis of rotation of said actuator rod and the axis of rotation of said rigid member as said rigid member is shifted between its locking and unlocking positions.

24. The chair control of claim 23 in which said rigid member includes a leg projecting laterally of said pivot axle and having a slot therein which engages said lever of said actuator rod; said leg including a notch therein; said spring means being seated in said notch.

25. In a chair control having a stationary member for mounting to a base, a tiltable member pivotally mounted with respect to said stationary member, bias means operably connected between said stationary and tiltable members for controlling the rate of tilt of said tiltable member with respect to said stationary member and for biasing said tiltable member to a normal position, and means for locking said tiltable member with respect to said stationary member, the improvement in said chair control comprising: said locking means including a rigid member movably mounted on said chair control; actuator means mounted on said chair control and operably connected to said rigid member for moving said rigid member between a locking position and an unlocking position, said rigid member being of such a configuration and having such an orientation in its mounting to said chair control that when in said locking position, it extends from a position of operable engagement with said tilting member to a position of operable engagement with said stationary member, thereby preventing relative movement of the two, and such that when in said unlocking position, it is out of operable engagement with one of said tiltable and stationary members whereby said tiltable member can tilt with respect to said stationary member; said rigid member including a generally flat plate which is mounted for pivotal movement on a pivot axle which is mounted to said other side of tiltable and stationary members; said actuator means comprising a pivotally mounted actuator rod having a deviation therein defining a lever; said rigid member including a leg projecting laterally of said pivot axle and having a slot therein which engages said lever of said actuator rod; said rigid member including a generally flat metal plate, said leg of said rigid member being integrally formed of said metal plate and being bent laterally out of the plane of said metal plate.

26. The chair control of claim 25 in which said rigid member further comprises a pair of spaced end legs on either side of said leg, said end legs being integrally formed of said metal plate by bending laterally out of the plane of said plate, said end legs having apertures therein through which said pivot axle passes.

27. The chair control of claim 26 in which said bias means comprises a spring having a pair of looped ends looped around said actuator rod on its axis of rotation, a rearwardly extending leg extending rearwardly from each of said looped ends, an upwardly extending leg extending upwardly from each of said rearwardly extending legs and a right portion joining the ends of said upwardly extending legs, said right portion being seated in said notch of said leg on said rigid member.

28. The chair control of claim 25 in which said rigid member further includes a pair of spaced end legs which extend over the rear edge of said stationary member when said rigid member is in its locking position, said end legs comprising that portion of said rigid member which are in operable engagement with said stationary member when said rigid member is in its locking position, said rear legs being positioned in very close proximity to the rear of said stationary member but being spaced slightly therefrom whereby they do not clank noisely against said stationary member when said rigid member is moved into its locking position.

29. The chair control of claim 28 in which said plate of said rigid member extends downwardly farther than said end legs to a point generally behind the rear of said stationary member, in close proximity thereto but just out of engagement therewith when said chair control is in its normal position, whereby said plate serves a safety stop to insure that said plate will not be moved past its locking position in the event of failure of said stop means.

30. The chair control of claim 1 including spring means operably mounted between said lever and said rigid member for biasing said rigid member towards either its locking or unlocking position.

* * * * *

UNITED STATES PATENT AND TRADEMARK OFFICE

CERTIFICATE OF CORRECTION

PATENT NO. : 4,438,898

DATED : March 27, 1984

INVENTOR(S) : Jack R. Knoblauch et al

It is certified that error appears in the above-identified patent and that said Letters Patent is hereby corrected as shown below:

In the Title:
"CHAIN" should be --CHAIR--;

Column 3, line 23:
"thereof," should be --thereof.--;

Column 3, line 56:
"ribs," should be --ribs.--;

Column 4, line 36:
"itself" should be --itself--;

Column 5, line 5:
before "generally" insert --a--; and

Column 8, line 28:
"comprise" should be --comprises--.

Signed and Sealed this

*Sixteenth* Day of *October 1984*

[SEAL]

*Attest:*

GERALD J. MOSSINGHOFF

*Attesting Officer*

*Commissioner of Patents and Trademarks*